US006789834B2

(12) United States Patent
Schlegel

(10) Patent No.: US 6,789,834 B2
(45) Date of Patent: Sep. 14, 2004

(54) DRIVABLE FLAP HINGE

(75) Inventor: Peter Schlegel, Wuppertal (DE)

(73) Assignee: Edscha AG, Remscheid (DE)

( * ) Notice: Subject to any disclaimer, the term of this patent is extended or adjusted under 35 U.S.C. 154(b) by 0 days.

(21) Appl. No.: 10/239,959

(22) PCT Filed: Apr. 6, 2001

(86) PCT No.: PCT/DE01/01382

§ 371 (c)(1),
(2), (4) Date: Sep. 25, 2002

(87) PCT Pub. No.: WO01/81699

PCT Pub. Date: Nov. 1, 2001

(65) Prior Publication Data

US 2003/0089040 A1 May 15, 2003

(30) Foreign Application Priority Data

Apr. 20, 2000 (DE) ..... 100 19 738

(51) Int. Cl.[7] ..... E05F 15/12

(52) U.S. Cl. ..... 296/76; 296/193.11; 296/146.8; 296/136.04; 49/340; 49/341; 49/359

(58) Field of Search ..... 296/76, 193.11, 296/146.4, 146.8, 146.11, 146.12, 136.04, 136.05, 136.06; 49/339, 340, 341, 342, 343, 344, 345, 359

(56) References Cited

U.S. PATENT DOCUMENTS 2,668,320 A * 2/1954 Lustig ..... 16/289
2,811,348 A 10/1957 Brundage ..... 268/74
2,845,299 A * 7/1958 Pickering ..... 296/136.06
5,018,687 A * 5/1991 Kupfernagel et al. .... 244/129.5
5,050,049 A * 9/1991 Shichijoh et al. ..... 362/527
5,435,406 A * 7/1995 Gaffoglio et al. ..... 180/69.21
5,743,587 A * 4/1998 Alexander et al. ..... 296/108
5,758,389 A * 6/1998 Wolda ..... 16/308
5,873,619 A * 2/1999 Lewkoski et al. ..... 296/76
6,181,094 B1 * 1/2001 Menke ..... 318/434
6,227,612 B1 * 5/2001 Stolle et al. ..... 296/208
6,254,165 B1 * 7/2001 Neubrand ..... 296/76
6,269,521 B1 * 8/2001 Gabel ..... 16/287
6,309,005 B1 * 10/2001 Priest et al. ..... 296/100.06
6,520,557 B2 * 2/2003 Benthaus et al. ..... 296/76
6,601,903 B2 * 8/2003 Nakagome ..... 296/76
2003/0020300 A1 * 1/2003 Zipperle ..... 296/136
2003/0038500 A1 * 2/2003 Aubry ..... 296/76

FOREIGN PATENT DOCUMENTS

DE 4141820 6/1993
DE 29705362 6/1997
DE 19744908 4/1999

* cited by examiner

*Primary Examiner*—Patricia L. Engle
(74) *Attorney, Agent, or Firm*—Davidson, Davidson & Kappel, LLC

(57) ABSTRACT

A drivable flap hinge for connecting a flaps such as a front hood or a trunk lid, to a body of an automobile in an articulated manner. The drivable hinge includes a first retaining part for fixing to the flap, a second retaining part for fixing to the body, at least one connecting member, which is pivotably arranged on at least one of the two retaining parts with a joint, and a driving motor, which is drive-connected to a joint pin of the joint. The flap hinge advantageously enables a front gate or tail gate of an automobile to pivot in a driven manner as a result of the driven joint pin connecting the first retaining part and the connection member.

17 Claims, 4 Drawing Sheets

DRIVABLE FLAP HINGE

BACKGROUND OF THE INVENTION

The present invention relates to a drivable flap hinge for connecting a flap, such as a front hood or a trunk lid, to a body of an automobile in an articulated manner, including a first mounting part for fixing to the flap, a second mounting part for fixing to the body, at least one link, which is pivotably arranged on at least one of the two mounting parts by means of a joint, and a driving motor, which is drive-connected to a joint pin of the joint.

DE-A-197 44 908 describes a drive apparatus for a front or tail flap of an automobile, comprising a flap hinge, in which a joint pin of a joint corresponds to the transmission output shaft of a driving motor, which, like the joint, is arranged in the region of a body-side mounting part. The particular disadvantage of this apparatus is the space requirement for the motor in the region of the body-side mounting parts, since they are generally arranged as far out as possible and thus allow a motor to be mounted only under very unfavorable conditions, if at all, e.g. outside the trunk, within the wing, for which purpose the shaft is passed through the metal of the body and has to be sealed and there is virtually no protection against dirt and water.

SUMMARY OF THE INVENTION

It is an object of the present invention to provide a drivable flap hinge, which advantageously allows the motorized pivoting of a front or tail flap of an automobile The present invention provides a drivable flap hinge for connecting a flap to a body of an automobile in an articulated manner. The flap hinge includes a first mounting part for fixing to the flap, a second mounting part for fixing to the body, at least one first link pivotably arranged on at least one of the first and second mounting parts using a joint including a joint pin, and a driving motor. The driving motor is drive-connected to the joint pin, and the driven joint pin connects the first mounting part and the at least one first link.

The drivable flap hinge according to the invention enables a flap pivotally connected to the vehicle body, in particular a front hood or a trunk lid, to be moved backward and forward between a closed position and an open position, for which purpose the driving motor is arranged essentially outside the region of the body-side mounting part, thus allowing the body-side mounting part to be mounted as far as possible to the outside on the body. It is not necessary to mount the driving motor within the wing, which makes access to it difficult and involves drilling through the body. Moreover, advantageous forces and moments act in the arrangement according to the invention, enabling the driving motor to be of smaller configuration and requiring less energy to be supplied.

The flap hinge according to the invention can be employed with a large number of flaps on automobiles, in particular with front hood or trunk lids, but also, in principle, with other flaps mounted on a vehicle for example with lids of convertible-top compartments or the like.

A further link is preferably provided, being connected to the first and the second mounting part in an articulated manner, so that the two links define a four-joint linkage, by means of which the two mounting parts are pivoted relative to one another.

According to a first preferred refinement of the flap hinge, the driving motor is arranged as an extension of the first, flap-side mounting part and drives a joint pin fixed in the link. In this case, the driving motor can be positioned at an inconspicuous position in the region of the flap, in particular against or in the vicinity of the flap-side mounting part without the need to provide a special installation space for this purpose.

According to another preferred refinement, the driving motor is arranged as an extension of the link and drives a joint pin fixed in the first, flap-side mounting part. Through its arrangement as an extension of the link or parallel to the link, the driving motor can advantageously follow the latter's pivoting motion during the opening of the flap without obstructing the pivoting motion of the flap hinge as a whole. Moreover, the driving motor can be arranged on the inward-facing side of the link, and the body-side mounting part can thus still be arranged as far out as possible on the body.

Provision is preferably made for an opposite end of the driving motor from the driven joint pin, which is connected in a rotationally fixed manner to the body-side mounting part, to be supported in an articulated manner on the second mounting part. This makes it possible to mount the driving motor to the outside of the link on whose joint the driving motor engages, but nevertheless to do it in a pivotable manner. In a particularly preferred variant, this enables the link itself to be eliminated, with the result that the driving motor with its associated housing has an extent designed to correspond to a link, which allows it to be mounted in an articulated manner at its end remote from the driven joint pin in such a way that pivoting past another link is possible, for example, thus making it possible to eliminate a separate part as a link. In this case, the driving motor itself is designed as a link.

According to a preferred development, it is possible, in the case of support on the body-side mounting part, for the same driving motor that already drives the joint pin likewise to drive a further joint pin in the region of its pivotable connection to the body-side mounting part.

A gear, which performs an increase or reduction in the rotational speed of the motor, can expediently be arranged between the driving motor and the driven joint pin. This advantageously makes it possible, for example, to provide a conventional electric motor as a standard part, which is adapted by means of the gear, as a separate subassembly, to the torques and forces acting on the driven joint pin. The joint pin then expediently has a circumferentially toothed portion, which meshes with a circumferentially toothed drive wheel of the gear.

According to yet another preferred refinement, provision is made for the driving motor to drive the hinges arranged on both sides of the flap, thus eliminating synchronization of the two drives for respective flaps driven by a motor in the case of an electric flap drive and furthermore ensuring that opening and closing of the flap takes place without tilting. For this purpose, the driving motor is optionally arranged on one flap hinge and connected to the other flap hinge by a shaft.

Preferably, however, the driving motor is arranged underneath the flap, expediently close to the pivoting axis, both flap hinges being connected to the driving motor by a shaft. Particularly suitable for this purpose is a flexible shaft, which has a certain play in its rotation and thereby allows coupling to the flap hinge while simultaneously being capable of compensating for bending of the flap due to its own weight or dynamic stresses.

It has to be understood that this arrangement can also be used to actuate the flap in the case of a single-joint hinge.

A spring energy store is preferably provided to assist the driving motor at least temporarily during the opening motion, especially in the range of the initial pivoting of the flap. It is thereby possible to assist the opening travel, in particular, which is intensive in terms of power owing to unfavorable torque conditions and is therefore associated with a slow pivoting motion. The spring energy store can be designed as a gas-pressure spring, which extends to assist the flap hinge, or as a leaf spring or in some other suitable configuration. According to a particularly preferred variant, the spring energy store can be integrated into the link, and can be loaded by means of the driving motor during the closure of the flap hinge.

The driving motor expediently has a watertight enclosure to protect its components. The driving motor is preferably provided with a multi-plate clutch or some other comparable clutch member in order to allow manual actuation of the flap despite failure of the motor.

Further advantages and features of the invention will become apparent from the following description and from the claims.

DESCRIPTION OF THE DRAWINGS

The invention is explained in greater detail below by means of preferred exemplary embodiments with reference to the attached drawings.

DETAILED DESCRIPTION

Figure 1:
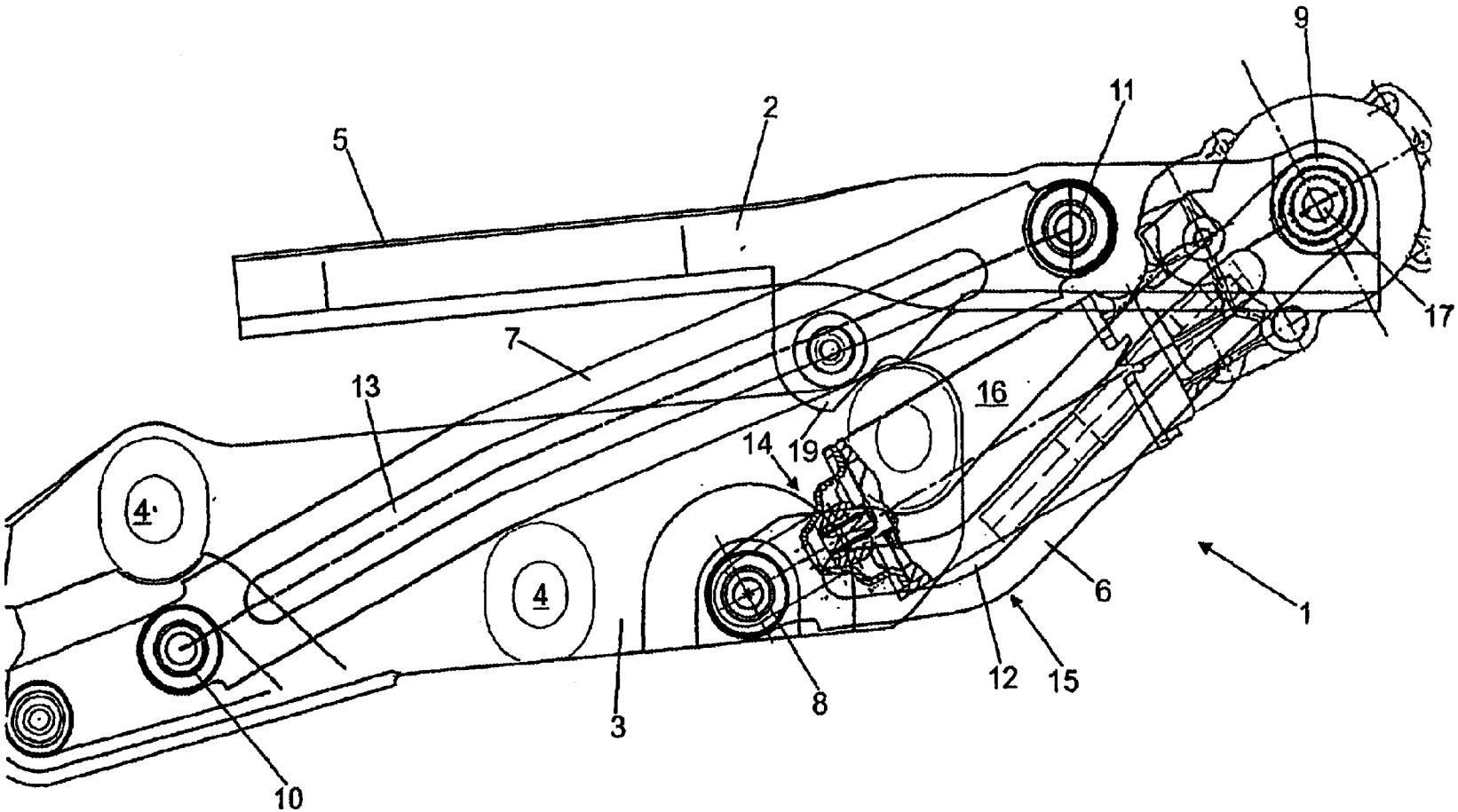
FIG. 1 shows a first exemplary embodiment of a flap hinge according to the invention in a side view.

The flap hinge shown in FIG. 1 and denoted overall by reference numeral 1 is configured as a four-joint hinge and comprises a first mounting part 2, which is designed for connection to a flap, such as a front hood, and a second mounting part 3, which is designed for connection to a body. In this arrangement, the connection to the body is made by means of screws, which pass through holes 4 in the second mounting part 3. The connection to the flap is, for example, likewise made by means of screws in holes in the first mounting part 2, which are provided in an essentially horizontal portion 5 of the first mounting part 2 and are not illustrated in FIG. 1.

The first mounting part 2 and the second mounting part 3 are coupled pivotably to one another by means of a first link 6 and a second link 7 in the form of a four-joint binge, such that the flap performs a pivoting motion about an instantaneous pole of the four-joint linkage during opening or closure. The first, rear (aft) link 6 is connected to the second mounting part 3 in a pivotably articulated manner by means of a joint 8 and is connected pivotably to the first mounting part 2 by means of a joint 9. The other link 7 is connected pivotably to the second mounting part 3 by means of a joint 10 and pivotably to the first mounting part 2 by means of a joint 11. Between the respective joints 8, 9 and 10, 11, both links 6, 7 are constructed with a reinforcing bead 12 and 13, respectively, which is provided primarily for reasons of sturdiness.

It can be seen that the first link 6 has a bent shape that defines a knee 15 and a step 14.

A driving motor 16, which is designed as an electric motor in the present case, drives a shaft designed as a joint pin 17 of the joint 9, the shaft 17 being driven by means of a gear, e.g. a planetary gear, and a suitable slipping clutch, such as a multi-plate clutch. The opposite end of the driving motor 16 or housing of the latter from the shaft 17 is supported against the first link 6 in the region of the step 14 of the latter, the physical connection being designed such that the driving motor 16 is arranged with its housing on the opposite side of the link 6 from the second, body-side mounting part 3 in such a way that the link 6 can still pivot past the second mounting part 3 and also the other link 7. Fixing is expediently accomplished by means of a screw but can also be form-locking. The drive shaft 17 of the joint 9 is fixed in the first mounting part 2, with the result that, when the driving motor 16 is actuated, e.g. using a remote control, on the basis of a user-defined signal, by means of signals converted electrically in an appropriate manner, the motor 16 drives the shaft 17 either in the direction for opening or closing the flap hinge 1, a pivoting motion of the link 6 and the driving motor 16 about this axis being induced owing to the firm seating of the shaft 17 in the first mounting part 2 and bringing about the pivoting motion of the flap hinge 1, which is designed as a four-joint hinge. If the driving motor 16 fails, the flap can also be opened by hand, the shaft, which is then driven manually, being either freely rotatable owing to idle motion of the driving motor or being disengaged from the gear of the driving motor 16 owing to the multi-plate clutch.

Figure 2:
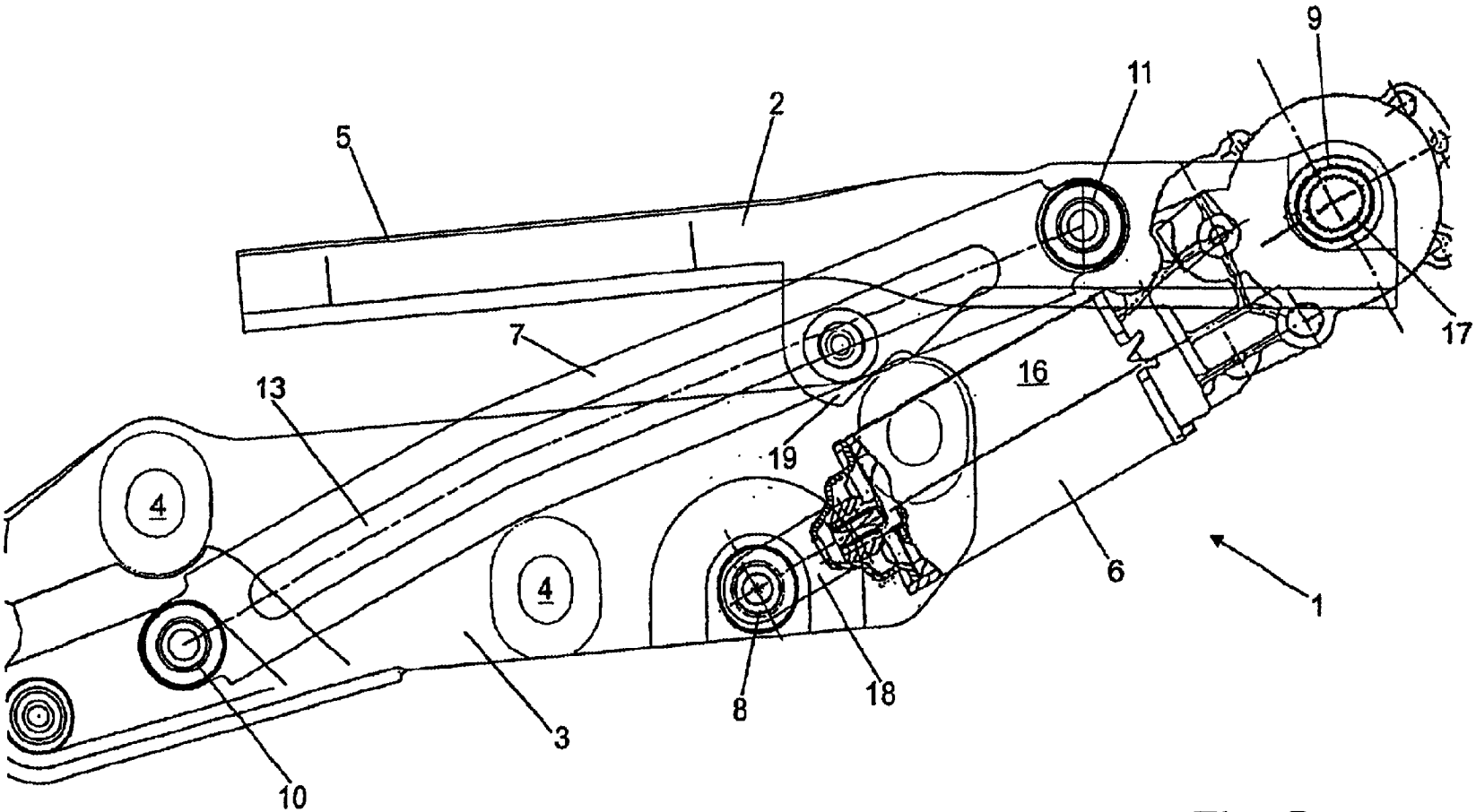
FIG. 2 shows a second exemplary embodiment of a flap hinge according to the invention in a side view.
Figure 3:
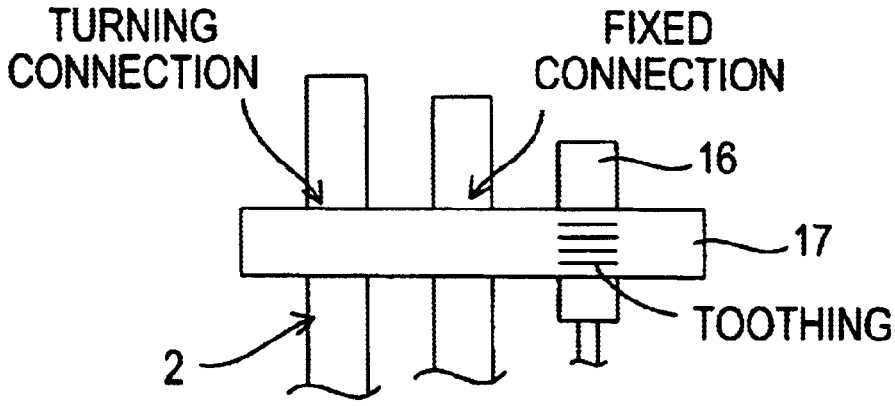
FIG. 3 shows a schematic partial top view of the flap hinge of FIG. 1.
Figure 4:
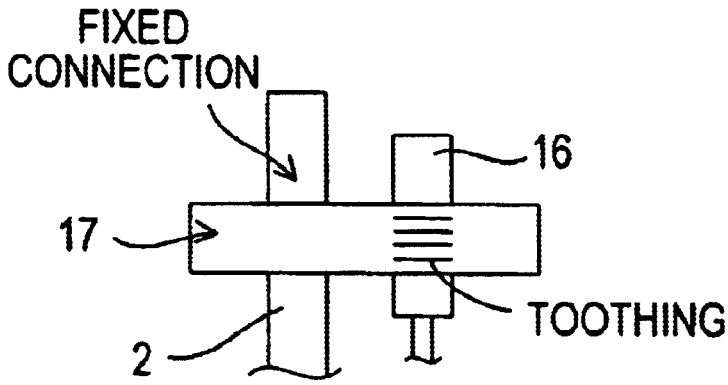
FIG. 4 shows a schematic partial top view of the flap hinge of FIG. 2.
Figure 5:
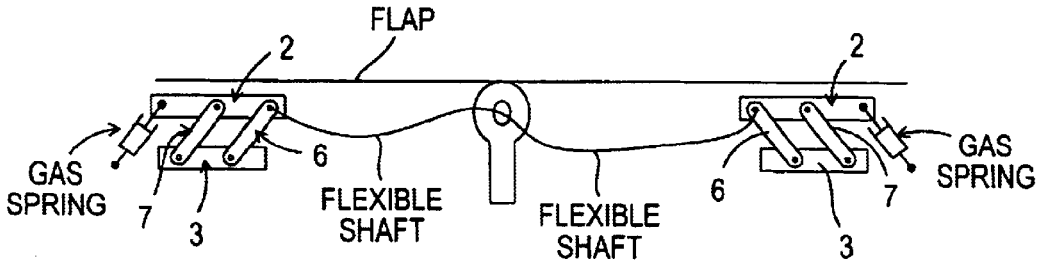
FIG. 5 shows a schematic view of a motor driving two flap hinges with a flexible shaft.
Figure 6:
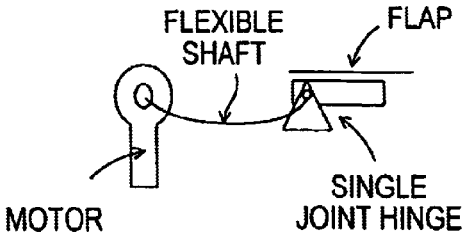
FIG. 6 shows a schematic view of a motor driving a single joint hinge with a flexible shaft.

The flap hinge illustrated in FIG. 2 and provided with reference numeral 1' is designed and constructed on the same principle as the flap hinge 1 in FIG. 1, for which reason the same reference numerals as in the previous exemplary embodiment denote the same functional parts and essentially only the differences with respect to FIG. 1 are explained below.

In the case of the flap hinge 1', the link 6' has been replaced by the driving motor 16, which is designed as a link, such that an extension 18 provided on the opposite end of the driving motor 16 from the joint 9 is supported in an articulated manner in the joint 8. The driving of the shaft 17 is unchanged compared with the previous exemplary embodiment but, in addition to a saving of materials, there is also advantageously a saving in terms of space by virtue of the fact that the portion of the link 6' which is provided with reference numeral 18 and extends the driving motor 16 need only be directed to the second mounting part 3 in the region of this pivotal connection, thereby allowing the two links 6', 7 to pivot past one another in a particularly favorable manner.

A projection 19 projecting from the first mounting part 2 defines, with its front side, a stop in relation to a corresponding shaped feature on the second mounting part 3, preventing the flap hinge 1 from collapsing and simultaneously defining the closed position of the flap hinge 1.

What is claimed is:

1. A drivable flap hinge for connecting a flap to a body of an automobile in an articulated manner, the flap hinge comprising:

a first mounting part for fixing to the flap;

a second mounting part for fixing to the body;

at least one first link pivotably arranged on the first mounting parts using a joint including a joint pin; and a driving motor, said driving motor being rotationally drive-connected to the joint pin, wherein the driven joint pin connects the first mounting part and the at least one first link.

2. The flap hinge as claimed in claim 1, wherein at least one second link connects the first mounting part and the second mounting part in an articulated manner to form a four-joint hinge.

3. The flap hinge as claimed in claim 1, wherein the driving motor is arranged as an extension of the at least one first link, and wherein the joint pin driven by the driving motor is fixed with respect to the first mounting part.

4. The flap hinge as claimed in claim 1, wherein the driving motor is arranged as an extension of the first mounting part, and wherein the joint pin driven by the driving motor is fixed with respect to the at least one first link.

5. The flap hinge as claimed in claim 1, wherein the driving motor includes a housing, and wherein an end of the housing opposite from the driven joint pin is supported in an articulated manner on the second mounting part.

6. The flap hinge as claimed in claim 5, wherein the housing of the driving motor is configured as the at least one link.

7. The flap hinge as claimed in claim 1, wherein the joint pin includes circumferential toothing.

8. The flap hinge as claimed in claim 1, wherein the driving motor drives a second flap hinge of the flap.

9. The flap hinge as claimed in claim 8, wherein the driving motor drives the second flap hinge using a flexible shaft.

10. The flap hinge as claimed in claim 8, wherein the driving motor is arranged in a middle region of the flap, the joint pin being drivable using a first shaft and a second joint pin of the second flap hinge is drivable using a second shaft.

11. The flap hinge as claimed in claim 8, wherein the driving motor drives the flap hinge using a first flexible shaft and the second shaft hinge using a second flexible shaft, and drives a first reduction gear arranged in a region of the flap hinge and a second reduction gear arranged in a region of the second flap hinge.

12. The flap hinge as claimed in claim 1, further comprising a spring energy store for at least partially assisting the driving motor.

13. The flap hinge as claimed in claim 12, wherein the spring energy store includes a gas-pressure spring.

14. The flap hinge as claimed in claim 1, wherein the driving motor includes a watertight enclosure.

15. A driving motor assisted flap of a vehicle, comprising:

a driving motor disposed on the flap; and two flap hinges for connecting the flap to a body of the vehicle in an articulated manner, wherein each of the flap hinges includes: a first mounting part for fixing to the flap; a second mounting part for fixing to the body; and a joint pin for connecting the two mounting parts, wherein the driving motor is drive-connected to the joint pin by a flexible shaft.

16. The flap as claimed in claim 15, wherein each of the flap hinges further include at least one link for connecting the first mounting part and the second mounting part using the joint pin, and wherein the flap hinges are four-joint hinges.

17. The flap as claimed in claim 15, wherein the flap hinges are single-joint hinges.

* * * * *